United States Patent [19]

Kehrer

[11] Patent Number: 4,700,773

[45] Date of Patent: Oct. 20, 1987

[54] NESTED-TUBE HEAT EXCHANGER

[75] Inventor: Wolfgang Kehrer, Berlin, Fed. Rep. of Germany

[73] Assignee: Borsig GmbH, Berlin, Fed. Rep. of Germany

[21] Appl. No.: 884,480

[22] Filed: Jul. 11, 1986

[30] Foreign Application Priority Data

Sep. 18, 1985 [DE] Fed. Rep. of Germany ..... 3533219

[51] Int. Cl.[4] ..... F28F 19/00

[52] U.S. Cl. ..... 165/134.1; 165/158

[58] Field of Search ..... 165/134.1, 158

[56] References Cited

U.S. PATENT DOCUMENTS

| | | | |
|---|---|---|---|
| 3,001,766 | 9/1961 | Laist | 165/135 X |
| 3,132,691 | 5/1964 | Esleek | 165/134.1 |
| 3,356,135 | 12/1967 | Sayre | 165/134.1 X |
| 3,465,727 | 9/1969 | Tidball | 165/134.1 X |
| 3,504,739 | 4/1970 | Pearce | 165/134.1 |
| 4,224,982 | 9/1980 | Frei | 165/134.1 |
| 4,245,696 | 1/1981 | Van Der Lelis | 165/158 X |
| 4,252,182 | 2/1981 | Fender | 165/134.1 |
| 4,401,153 | 8/1983 | Marsch et al. | 165/134.1 |
| 4,431,049 | 2/1984 | Zamma et al. | 165/158 X |
| 4,585,057 | 4/1986 | Marburger | 165/134.1 |

FOREIGN PATENT DOCUMENTS 1953628 5/1973 Fed. Rep. of Germany .

*Primary Examiner*—Albert W. Davis, Jr.
*Assistant Examiner*—Richard R. Cole
*Attorney, Agent, or Firm*—Max Fogiel

[57] ABSTRACT

A nested-tube heat exchanger with tubes that are secured at each end in tube plates, for exchanging heat between materials at very different pressures. The first material, which flows through the tubes is very hot when it enters. One tube plate is thinner than the other and rests on a supporting plate. The supporting plate is fastened to a jacket that surrounds the nest of tubes. Each tube is surrounded by an annular gap where they extend through the supporting plate. To prevent particles in the water from depositing on the thinner tube plate, there are supporting fingers between the thinner tube plate and the supporting plate, the supporting plate is fastened to an inner supporting jacket and the thinner tube plate to an outer supporting jacket, both supporting jackets are attached to the jacket that surrounds the nest of tubes and demarcate an annular chamber, and the outer supporting jacket has a connection for supplying water and the inner supporting jacket has an access aperture at the side of the annular chamber that is remote from the water-supply connection.

4 Claims, 2 Drawing Figures

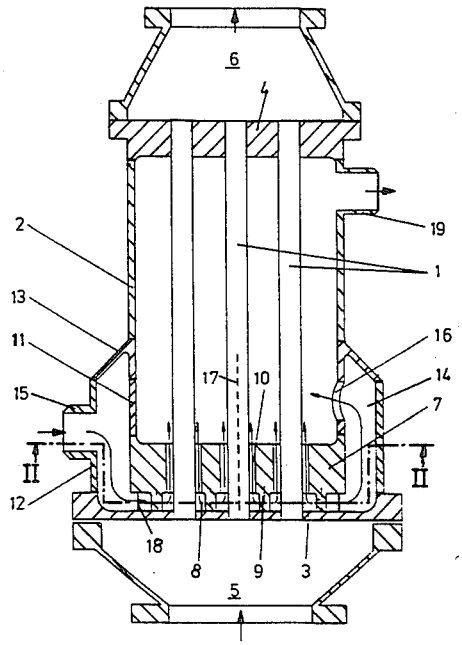

NESTED-TUBE HEAT EXCHANGER

The invention concerns a nested-tube heat exchanger with tubes that are secured at each end in tube plates, for exchanging heat between materials at very different pressures, with the first material, which flows through the tubes being very hot when it enters, whereby one tube plate is thinner than the other and rests on a supporting plate that is fastened to a jacket that surrounds the nest of tubes and whereby the tubes are surrounded by an annular gap where they extend through the supporting plate.

The thinner tube plate in a known heat exchanger (German AS No. 1 953 628) rest on the ends of the nest of tubes on a supporting plate, which results in an unreliable design. The ends of the tubes are surrounded by jacket tubes that extend into the vicinity of the thinner tube plate, leaving an annular gap. The cooling water, which is supplied to an intake chamber between the thinner tube plate and the supporting plate, flows first along the thinner tube plate and into the heat exchanger through the annular gaps.

The thinner tube plate in another known heat exchanger is reinforced with pieces of sheet metal. These reinforcing sheets are positioned away from the thinner tube plate and are rigidly secured to it with connecting rods. Measures to convey the coolant to the thinner tube plate are provided.

The coolant is water, which circulates between the heat exchanger and evaporates. The water, which always contains fine magnetite and can also contain other impurities, is conveyed to the center from outside in both heat exchangers. Since the water flows up prematurely in the outer region, the speed at which the water flows decreases toward the center. Thus, water speeds that are low enough to promote deposit of the entrained particles on the slender tube plate at the gas-intake end can occur in the center of the heat exchanger. Large deposits occasion damage to the tube plate as the result of overheating.

SUMMARY OF THE INVENTION

The object of the invention is to design the support for the thinner tube plate in such a way as to prevent particles in the water from depositing on the plate.

This object is attained in accordance with the invention by supporting fingers between the thinner tube plate and the supporting plate, in that the supporting plate is fastened to an inner supporting jacket and the thinner tube plate to an outer supporting jacket, both supporting jackets being attached to the jacket that surrounds the nest of tubes and demarcating an annular chamber, and in that the outer supporting jacket has a connection for supplying water and the inner supporting jacket has an access aperture at the side of the annular chamber that is remote from the water-supply connection.

Two sheet-metal partitions that cover up the cross-section of the annular chamber extend through the chamber between the water-supply connection and the access aperture in one embodiment of the nested-tube heat exchanger in accordance with the invention.

Baffles that surround the supporting plate and cover up part of the intake cross-section of the space between the supporting plate and the thinner tube plate are positioned in the annular chamber on each side of the supporting plate in another embodiment of the nested-tube heat exchanger in accordance with the invention.

The supporting plate in the heat exchanger in accordance with the invention has a double function, not only supporting the thinner tube plate but also conveying the water. The forces deriving from the thinner tube plate through the supporting fingers are deflected into the jacket in the form of tensile forces. Since most of the water enters the heat exchanger through the access aperture, it is conveyed across the total tube plate at a high speed, preventing particles from depositing on the tube plate.

A preferred embodiment of the invention will hereinafter be described with reference to the appended drawings. It is to be understood, however, that this is merely by way of example and that the scope of the protection sought for the invention is defined exclusively in the claims.

DESCRIPTION OF THE PREFERRED EMBODIMENTS

Figure 1:
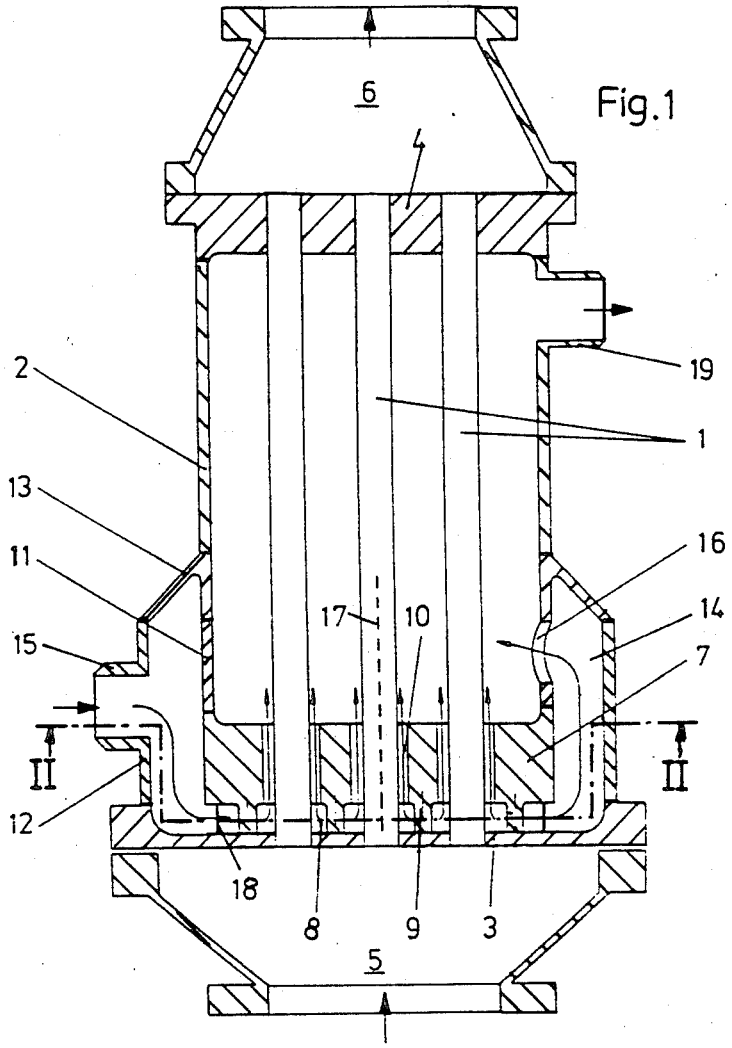
FIG. 1 is a longitudinal section through a heat exchanger in accordance with the invention and FIG. 2 is a section along the line II—II in FIG. 1.
Figure 2:
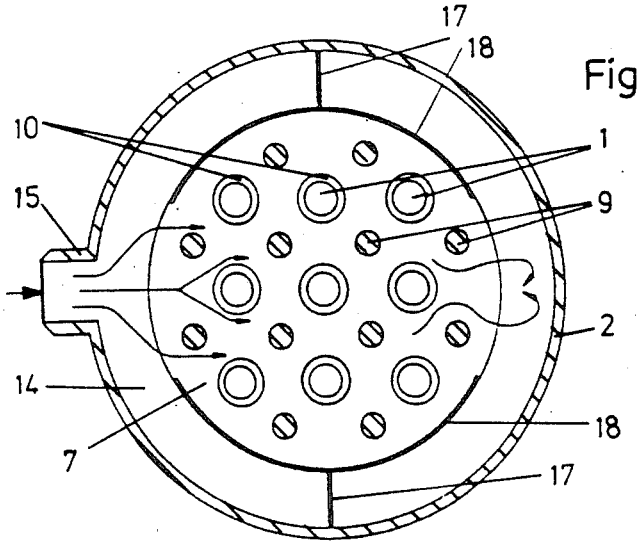

A heat exchanger of an erect design is intended in particular to cool cracked gases by means of evaporating water. It consists of a nest of individual tubes 1 that the gas to be cooled flows through and that are surrounded by a jacket 2. Tubes 1 are secured in two tube plates 3 and 4 with an intake 5 and an outlet 6 for the gas.

Tube plate 3, which is positioned at the gas-intake side, is thinner than tube plate 4. The side of thinner tube plate 3 that is remote from gas intake 5 is suspended from a supporting plate 7. Supporting plate 7 is positioned at a distance from tube plate 3, leaving a space 8. Supporting fingers 9 are cast onto supporting plate 7, and distributed around the cross-section between tube plate 3 and the plate. The tube plate 3 is suspended from supporting plate 7 through the supporting fingers 9. Tubes 1 extend loosely through supporting plate 7, each leaving an annular gap 10.

Thinner tube plate 3 is connected to an outer supporting jacket 12 and supporting plate 7 to an inner supporting jacket 11. Supporting jackets 11 and 12 are connected by a Y-channel ring 13 welded to jacket 2. Supporting jackets 11 and 12, which are connected by Y-channel ring 13, demarcate an annular chamber 14, which water is supplied through. Outer supporting jacket 12 has a connection 15 for supplying water. Inner supporting jacket 11 has an access aperture 16 on the side of annular chamber 14 that faces water-supply connection 15. Annular chamber 14 is separated into two subsidiary chambers between supply connection 15 and access aperture 16 by two radial sheet-metal partitions 17 that occupy the total cross-section of the chamber.

On each side of sheet-metal partitions 17 in annular chamber 14 are baffles 18 that surround part of the circumference of supporting plate 7. Baffles 18 rest erect on thinner tube plate 3 and cover up part of the intake cross-section of the space 8 between supporting plate 7 and the tube plate.

As indicted by the arrows in the figures, water enters annular chamber 14 through supply connection 15, and flows at a high speed through the space 8 between thinner tube plate 3 and supporting plate 7. A little water simultaneously penetrates into the inside of the heat exchanger through annular gaps 10. Most of the water, however, flows into the heat exchanger through access aperture 16 and partly evaporates, cooling the gas that flows through tubes 1. The evaporating water is removed through an outlet connection 19 in jacket 2 and flows through an unillustrated rising line into a steam-out drum.

The invention has been described herein with reference to an exemplary embodiment. It will be understood, however, that it is receptable of various modifications, which will offer themselves to those skilled in the art and which are intended to be encompassed within the protection sought for the invention as set forth in the appended claims.

I claim:

1. A nested-tube heat exchanger comprisng: tubes for exchanging heat between media at substantially different pressures and at diferent temperatures; said tubes conducting a medium of higher inlet temperature; a jacket surrounding said tubes; tube plates for securing said tubes at each end; one of said tube plates being thinner than the other, so that one of said tube plates is a thick tube plate and the other one of said tube plates is a thin tube plate; said thick tube plate fastened to said jacket; a supporting plate with supporting fingers arranged at a distance from said the in tube plate, said thin tube plate being suspended from said supporting plate by said supporting fingers, said supporting fingers being fastened to said supporting plate; each tube extending through said supporting plate with an annular gap between the tube and said supporting plate; an inner supporting jacket fastened to said supporting plate; an outer supporting jacket fastened to said thin tube plate; said two supporting jackets being both attached to said jacket surrounding said tubes and demarcating an annular chamber; said outer supporting jacket having a connection for supplying water; said inner supporting jacket having an access aperture at a side of said of said chamber which is remote from said connection for supplying water.

2. A nested-tube heat exchanger as defined in claim 1, including two sheet-metal partitions covering up the crosssection of said annular chamber and extending through said chamber between said access aperture and said connection for water supply.

3. A nested-tube heat exchange as defined in claim 1, including baffles surrounding said supporting plate and positioned in said annular chamber on each side of said supporting plate, said baffles covering up part of an intake cross section between said supporting plate and said thin tube plate.

4. A nested-plate heat exchanger comprising: tubes for exchanging heat between media at substantially different pressures and at different temperatures; said tubes conducting a medium of higher inlet temperature; a jacket surrounding said tubes; tube plates for securing said tubes at each end; one of said tube plates being thinner than the other, so that one of said tube plates is a thick tube plate and the other one of said tube plates is a thin tube plate; said thick tube plate fastened to said jacket; a supporting plate with supporting fingers arranged at a distance from said thin tube plate, said thin tube plate being suspended from said supporting plate by said supporting fingers, said supporting fingers being fastened to said supporting plate; each tube extending through said supporting plate with an annular gap between the tube and said supporting plate; an inner supporting jacket fastened to said supporting plate; an outer supporting jacket fastened to said thin tube plate; said two supporting jackets being both attached to said jacket surrounding said tubes and demarcating an annular chamber; said outer supporting jacket having a connection for supplying water; said inner supporting jacket having an access aperture at a side of said annular chamber which is remote from said connections for supplying water; two sheet-metal partitions covering up the cross-section of said annular chamber and extending through said chamber between said access aperture and said connection for water supply; and baffles surrounding said supporting plate and positioned in said annular chamber on each side of said supporting plate, said baffles covering up part of an intake cross-section between said supporting plate and said thin tube plate.

* * * * *